United States Patent [19]

Seeberger

[11] Patent Number: 4,823,935

[45] Date of Patent: Apr. 25, 1989

[54] APPARATUS FOR FEEDING MATERIAL TO AN ECCENTRIC-WORM PUMP

[75] Inventor: Fritz Seeberger, Bottrop, Fed. Rep. of Germany

[73] Assignee: Pumpen- und Maschinenbau Fritz Seeberger KG, Bottrop, Fed. Rep. of Germany

[21] Appl. No.: 191,203

[22] Filed: May 6, 1988

[30] Foreign Application Priority Data

May 9, 1987 [DE] Fed. Rep. of Germany ..... 3715542

[51] Int. Cl.[4] ..... B65G 47/16

[52] U.S. Cl. ..... 198/533; 222/238

[58] Field of Search ..... 198/533, 670, 671, 550.1; 222/238, 240, 241

[56] References Cited

U.S. PATENT DOCUMENTS 1,258,668 3/1918 Gaunit ..... 198/533 X 3,134,478 5/1964 Haen et al. ..... 198/550.1 X 3,403,828 10/1968 Biehl ..... 222/238 X 4,676,363 6/1987 Buchmüller et al. ..... 198/533 X

FOREIGN PATENT DOCUMENTS

G8521574 11/1985 Fed. Rep. of Germany .

*Primary Examiner*—Robert J. Spar

*Assistant Examiner*—Cheryl L. Gastineau

*Attorney, Agent, or Firm*—Herbert Dubno

[57] ABSTRACT

A feeder for an eccentric-worm pump of the type in which breaker shafts with paddles cast bulk material to a feeder worm in a funnel-shaped housing is connected to the eccentric worm pump. To increase the efficiency of the feeder, the paddles are inclined in accordance with the pitch of the feeder worm relative to the axes of the respective breaker shafts so that the material cast by the paddles is directed substantially tangentially to the helical rib of the feeder worm.

2 Claims, 2 Drawing Sheets

APPARATUS FOR FEEDING MATERIAL TO AN ECCENTRIC-WORM PUMP

FIELD OF THE INVENTION

My present invention relates to an apparatus for feeding material to an eccentric-worm pump and, more particularly, to a feeder for bulk materials which are susceptible to bridging, thereby reducing the continuity of flow of such materials through the feeder to the pump.

BACKGROUND OF THE INVENTION

An eccentric-worm pump generally is supplied with bulk material to be displaced by the pump, e.g. granular solids, viscous materials such as sewage sludge, and other flowable materials which are susceptible to bridging, with a feeder which may have a generally rectangular plan funnel structure which is provided above a trough in which a feed worm is disposed, advancing the material axially into the housing of the eccentric worm pump which can be of the Moineau-pump type.

Above the feed worm in the funnel, a pair of bridge breaker shafts can be provided and the shafts can have paddles whose outer ends define orbits around the axes of the breaker shafts which overlap in axial direction, i.e. the radial paddles of the two breaker shafts interdigitate.

The purpose of the breaker unit formed by the breaker shafts and their respective paddles is to prevent the formation of bridges of the bulk material to be displaced in the funnel across the downwardly converging walls thereof above the feeder shaft, such bridging tending to impede the continuity of flow of the bulk material downwardly through the funnel.

Such systems have been found to be highly effective where the bulk material, was, for example, sludge, especially activated sludge from the clarifiers of sewage-treatment plants, sludge from fermentation basins or the like. Usually such sludges, before being displaced with such pumps are subjected to a preliminary drying on so-called belt dryers or vacuum-belt dryers.

The feed worm and the bridge-breaker shafts generally are driven at speeds between 30 and 150 R.P.M., which speeds may be variable so that an optimum speed can be selected for the particular material displaced. The eccentric-worm pump is usually flanged by its eccentric to the worm shaft.

A system of this type is described in German Utility Model application DE-GM No. 85 21 574.

While the paddles have been found to be highly effective in preventing bridge formation or breaking any bridges which do form, especially when the bridge-breaker shafts are counter-rotating, i.e. are driven in opposite senses of rotation and have their paddles axially offset from one another from shaft to shaft to enable the respective orbits to overlap as described, it has nevertheless been found that it is possible to improve upon the efficiency of such feeders.

OBJECT OF THE INVENTION

It is the principal object of the present invention to provide a feeder for an eccentric-worm pump which has improved efficiency by comparison with the above-described feeder previously known for this purpose.

SUMMARY OF THE INVENTION

I have found, quite surprisingly, that the conventional arrangement of the paddles of the bridge breaker unit vis-a-vis the helical rib of the feeder worm has apparently resulted in a reduction of the possible efficiency of a feeder. Generally the paddles have been provided so that their broad faces lay substantially in axial planes of the respective breaker shafts and thus in planes which were parallel to the axis of the feeder worm. Even though efforts were made to bring the orbits of these paddles as close as possible to the orbit of the outer edge of the rib of the feeder worm and in practice the gaps between the orbits of the paddles and this orbit of the feeder worm usually were only several mm in width, the degree of filling of the feeder worm appeared to be limited.

I have now found that it is possible to increase the degree of filling of the feeder worm and thus the overall feeding efficiency of the device in terms of the amount of material which can be fed to the pump for a feeder of given dimensions and rotation speed of the various shafts.

According to the invention, the bridge-breaker paddles are inclined in accordance with the pitch of the helical rib of the feeder worm, with respect to the axes of their bridge-breaker shafts, so that the material cast from the bridge-breaker paddle is directed substantially tangentially to the worm rib in the region of closest approach of the paddle to the worm.

Specifically, the paddles are so oriented that their planes in the region of closest approach are perpendicular to the planes of the rib in these regions.

Preferably the bridge-breaker paddles are provided with a twist over their radial lengths so that in the region of their respective bridge-breaker shafts, they have a lesser inclination to the shaft axis than at their free ends distal from the bridge-breaker shaft.

Specifically, therefore, a feeder for an eccentric-worm pump can comprise:

- a housing formed with an upwardly open funnel of substantially rectangular plan configuration and with a feed trough closing the bottom of the funnel and opening axially into the worm pump;
- a feed worm rotatable in the housing and including a worm shaft extending in the trough and at least one generally helical rib formed on the worm shaft for displacing material introduced through the funnel into the worm pump; and
- a bridge breaker in the funnel above the feed worm, the bridge breaker comprising:
  - a pair of mutually parallel breaker shafts parallel to the worm shaft and spaced above the worm shaft, and
  - a multiplicity of breaker paddles mounted on the breaker shafts and projecting radially therefrom, the breaker paddles of the respective breaker shafts being offset on one breaker shaft with respect to the other breaker shaft and having lengths such that the orbits of the outer ends of the paddles of the two breaker shafts intersect and closely approach the orbit of the rib, the paddles having inclinations to the axes of the respective breaker shafts such that material cast from the paddles is projected substantially tangential to the direction of the rib at locations where the orbits of the paddles approach the orbit of the rib and planes of at least the outer ends are substantially perpendicular to places of the ribs at the locations.

The feeder of the present invention has been found to operate with a significantly higher degree of filling of the feeder worm and higher efficiency as defined previously. An especially important advantage is that the feeder permits a very effective mixing of the bulk material in the trough and it permits fine-grain dry additives, such as lime or cement, to be mixed with a high degree of homogeneity with the bulk materials to be fed to the eccentric-worm pump.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
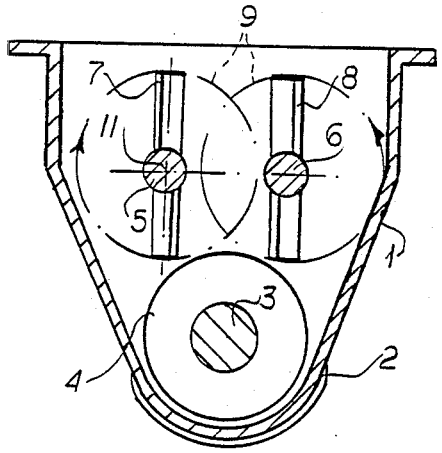
FIG. 1 is a vertical section through a feeder according to the invention.

The feeder shown in the drawing is intended to supply flowable bulk material to an eccentric-worm pump of the Moineau-pump type.

The apparatus comprises an elongated feed funnel 1 of rectangular plan configuration which converges toward a feeder housing 2 constituting a trough. In this housing 2 a feeding worm 3, 4 is rotatable.

In the funnel 1, a bridge-breaker arrangement is provided.

The feed worm 3,4, comprises a worm shaft 4 and a worm rib or flight 4 extending helically with a predetermined pitch.

The bridge-breaker arrangement comprises two bridge-breaker shafts 5 and 6 which are mutually parallel and extend parallel to the worm shaft 3. The bridge-breaker shafts 5 and 6 are driven in opposite senses as will be apparent from the arrows shown in FIGS. 1 and 2. The bridge-breaker shafts 5 and 6 each carry bridge-breaker paddles 7 and 8 which extend radially from the respective shafts.

Figure 2:
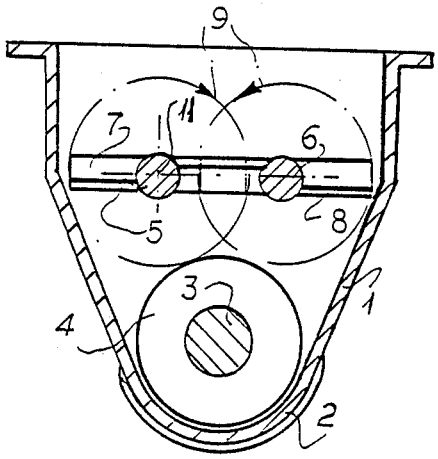
FIG. 2 is a view similar to FIG. 1 showing the breaker shafts and paddles in other positions.
Figure 3:
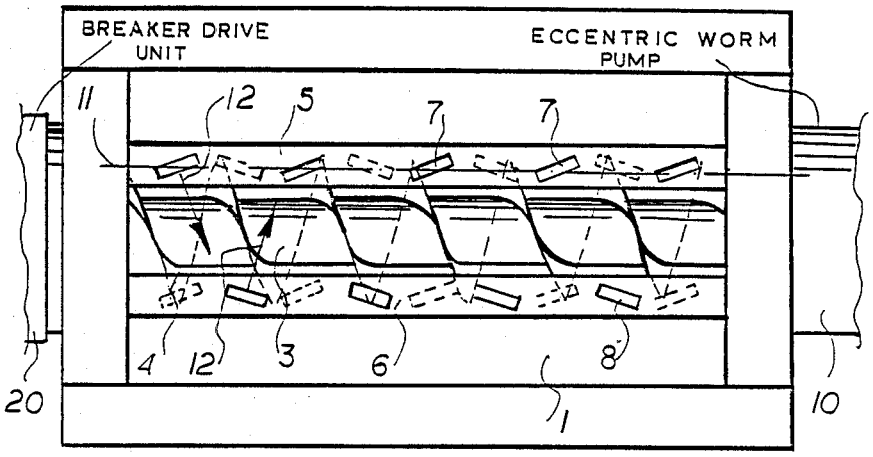
FIG. 3 is a plan view of the feeder of FIG. 1.

As can be seen in FIGS. 1 and 3, the free ends of the paddle 7 and 8 describe orbits 9 which overlap as seen in the axial direction for the paddles 7 and 8 and which closely approach the periphery of the feeder worm 3, 4.

Between the two bridge-breaker shafts 5 and 6, the bulk material is thrown against the feeder worm 3, 4.

The spacing between the orbits 9 and the paddles and the periphery of the worm rib 4 should be as small as possible and need only be at most several mm, for example 2 to 3 mm.

As can be seen from FIG. 3, the eccentric worm-pump housing 10 is connected to one end of the housing 2 while at the opposite end of the hopper and the housing, a drive unit 20 is provided for rotating of three shafts, preferably at a selectably variable speed.

Figure 4A:
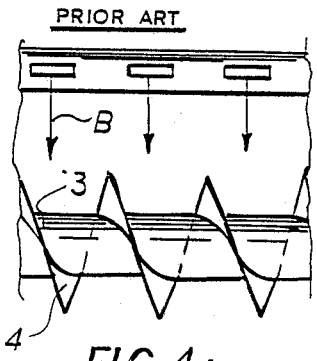
FIG. 4A is a view similar to FIG. 4 but showing the prior art arrangement.
Figure 4:
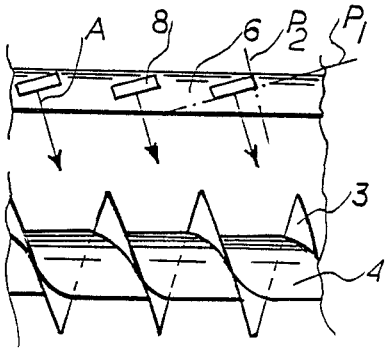
FIG. 4 is a diagram illustrating the relationship of the feeder worm of the invention to the inclined paddles.

As will be apparent from FIGS. 3 and 4, moreover, the paddles 7 and 8 are inclined to the axes 11 of their breaker shafts 5 and 6 in accordance with the pitch of the worm 4 so that the bulk material cast off by the paddles 7 and 8 is directed tangentially to the rib (see the arrows A in FIG. 4). This, of course, means 20 that the planes $P_1$ of these paddles are oriented substantially perpendicularly to the planes $P_2$ of the rib in the regions at which the paddles approach the rib.

FIG. 4A, by contrast, illustrates with arrows B the direction of the material cast from the paddles of a conventional breaker shaft in which those paddles lie in axial planes of the breaker shaft, i.e. are not inclined to the breaker-shaft axis.

With the system of the invention, there is an improvement in the degree of filling of the worm 3, 4 and therewith an improvement in the displacement efficiency of the device as well as an overall improvement in the efficiency of the assembly of the feeder with its eccentric-worm pump.

Figure 5:
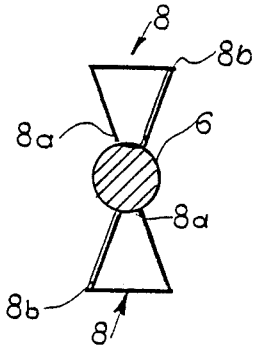
FIG. 5 is a sectional view through the breaker shaft showing a pair of paddles provided with twists in accordance with the present invention.

As can be seen from FIG. 5, each paddle 8, for example, of the breaker shaft 6 can have a lesser inclination to the axis of the breaker shaft 6 than the free end 8*b*, i.e. the paddles may have a twist to them as has been described.

I claim:

1. A feeder for an eccentric worm pump, comprising:

a housing formed with an upwardly open funnel of substantially rectangular plan configuration and with a feed trough closing the bottom of said funnel and opening axially into said worm pump;

a feed worm rotatable in said housing and including a worm shaft extending in said trough and at least one generally helical rib formed on said worm shaft for displacing material introduced through said funnel into said worm pump; and a bridge breaker in said funnel above said feed worm, said bridge breaker comprising:

a pair of mutually parallel breaker shafts parallel to said worm shaft and spaced above said worm shaft, and a multiplicity of breaker paddles mounted on said breaker shafts and projecting radially therefrom, said breaker paddles of the respective breaker shafts being offset on one breaker shaft with respect to the other breaker shaft and having lengths such that the orbits of the outer ends of said paddles of the two breaker shafts intersect and closely approach the orbit of said rib, said paddles having inclinations to the axes of the respective breaker shafts such that material cast from said paddles is projected substantially tangential to the direction of the rib at locations where said orbits of said paddles approach the orbit of said rib and planes of at least said outer ends are substantially perpendicular to planes of said ribs at said locations.

2. The feeder defined in claim 1 wherein each of said paddles is twisted and has a lesser inclination to the axis of the respective breaker shaft in a region close to the respective breaker shaft than at the outer end of the paddle.

* * * * *